United States Patent [19]

Lucas

[11] Patent Number: 4,507,902

[45] Date of Patent: Apr. 2, 1985

[54] DEVICE FOR THE FORMATION OF A JOINT FOR AN INDUSTRIAL TYPE FLOORING

[76] Inventor: Jean-Claude Lucas, 6, Allée Gaston Buy, F-35400 Saint-Malo, France

[21] Appl. No.: 386,894

[22] Filed: Jun. 10, 1982

[51] Int. Cl.[3] ..... E04B 2/00

[52] U.S. Cl. ..... 52/370; 52/371; 404/48

[58] Field of Search ..... 52/367, 370, 371, 318, 52/369, 687, 689, 688; 404/48

[56] References Cited

U.S. PATENT DOCUMENTS

| | | | |
|---|---|---|---|
| 2,257,421 | 9/1941 | Mabry | 52/689 X |
| 2,651,243 | 9/1953 | Guille | 404/48 |
| 3,398,497 | 8/1968 | Hellmich et al. | 52/318 X |
| 3,471,987 | 10/1969 | Yelsma | 52/689 X |
| 4,346,542 | 8/1982 | Tateno | 404/48 X |

FOREIGN PATENT DOCUMENTS

| | | | |
|---|---|---|---|
| 667411 | 10/1929 | France | 52/318 |

*Primary Examiner*—Carl D. Friedman

*Attorney, Agent, or Firm*—Laff, Whitesel, Conte & Saret

[57] ABSTRACT

Apparatus to make up joints in the construction of cement flooring intended, either to definitely remain in the cement, either to be recuperated, the said apparatus having a first part whose walls interlock on a second part serving as support, which has feet that anchor perfectly in the levelling cement.

10 Claims, 10 Drawing Figures

DEVICE FOR THE FORMATION OF A JOINT FOR AN INDUSTRIAL TYPE FLOORING

The present invention concerns an apparatus to make up joints in an industrial type flooring, generally made of cement, and the work process to achieve in these flooring retraction joints that are either finished or to be filled in with putty.

There already exist apparatus or setups to create joints in large cement surfaces. Regarding this subject, we may refer to the following: U.S. Pat. No. 2,651,243; U.S. Pat. No. 3,838,930; DE (German) No. 1,121,308; DE No. 1,409,785; DE No. 2,541,030 and GB (British) No. 291,997. None of the apparatus known or described above allow the simultaneous realization of the following operations:

(1) shuttering;

(2) support the vibrating rod;

(3) dry expansion joint, but rigidly locked with the retracting cement;

(4) expansion joint to be filled in with putty.

One aim of the present invention consists in foreseeing an apparatus which can perform all these operations and in particular which can be used for the construction of industrial type flooring. By industrial type flooring, we mean large cement surfaces used as ground in industrial buildings and in their immediate surroundings. But, of course, the apparatus in accordance with the invention may also be used to realize other types of flooring.

In accordance with a characteristic of the invention, an apparatus to make up joints is forseen, having a first piece whose profile is in the form of a clothes peg with legs that interlock with a second piece which has feet which are anchored in the cement.

The characteristic of the above-mentioned invention, as well as others, will appear more closely upon reading the following description of realization examples, the description being done in relation to the attached drawings, among which:

Figure 1:
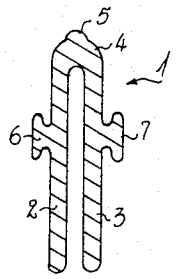
FIG. 1 is a sectional view of a first piece of the apparatus in accordance with the invention.

The section of FIG. 1 represents the shape of a rod 1, the shape being of the form of a clothes peg with two legs 2 and 3 with a summit 4 linking the two legs. The free ends of the legs 2 and 3 are rounded. The summit 4 may have at its center a light bulge 5. Spurs 6 and 7 are foreseen on the external flanges of the legs 2 and 3.

Figure 2:
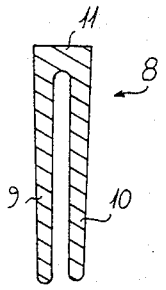
FIG. 2 is a sectional view of a variation of the piece of FIG. 1.

The cut of FIG. 2 represents the shape of another rod 8, the profile being also that of a clothes peg with two legs 9 and 10, whose external faces are smooth and a summit 11 joining the upper extremities of legs 9 and 10. The top face of summit 11 is horizontal.

Figure 3:
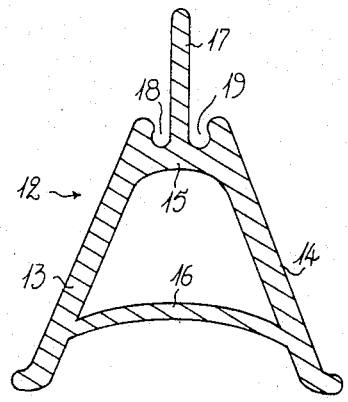
FIG. 3 is a sectional view of a second piece cooperating with the piece of FIG. 1 or FIG. 2 to form an apparatus in accordance with the invention.

The cut of FIG. 3 represents the shape of an element 12, the profile being in the form of an A with two oblique legs 13 and 14 whose upper extremities are joined by a summit 15 and a horizontal bar 16 between the inferior parts of legs 13 and 14. The apex or summit 15 is surmounted by a vertical bar 17. At various locations of the base of 17, hollows 18 and 19 opened towards the top, are foreseen in the upper face of summit 15. Bar 16 has the shape of a street between legs 13 and 14. When we assemble parts 1 and 12, legs 2 and 3 straddle bar 17, the rounded ends of 2 and 3 lodging in the hollows 18 and 19. In an assembly of parts 8 to 12, it is the legs 9 and 10 which straddle bar 17.

Figure 4:
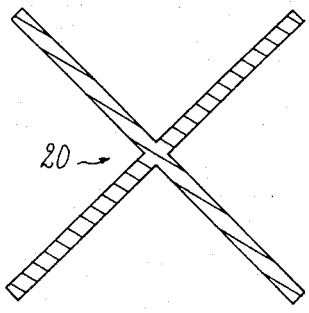
FIG. 4 is a sectional view of an assembly part used with the parts of FIGS. 1 to 3.

The section of FIG. 4 represents the shape of an element 20, the profile being that of an X with straight dihedrals, whose angle of intersection is destined to be set vertically.

Figure 5:
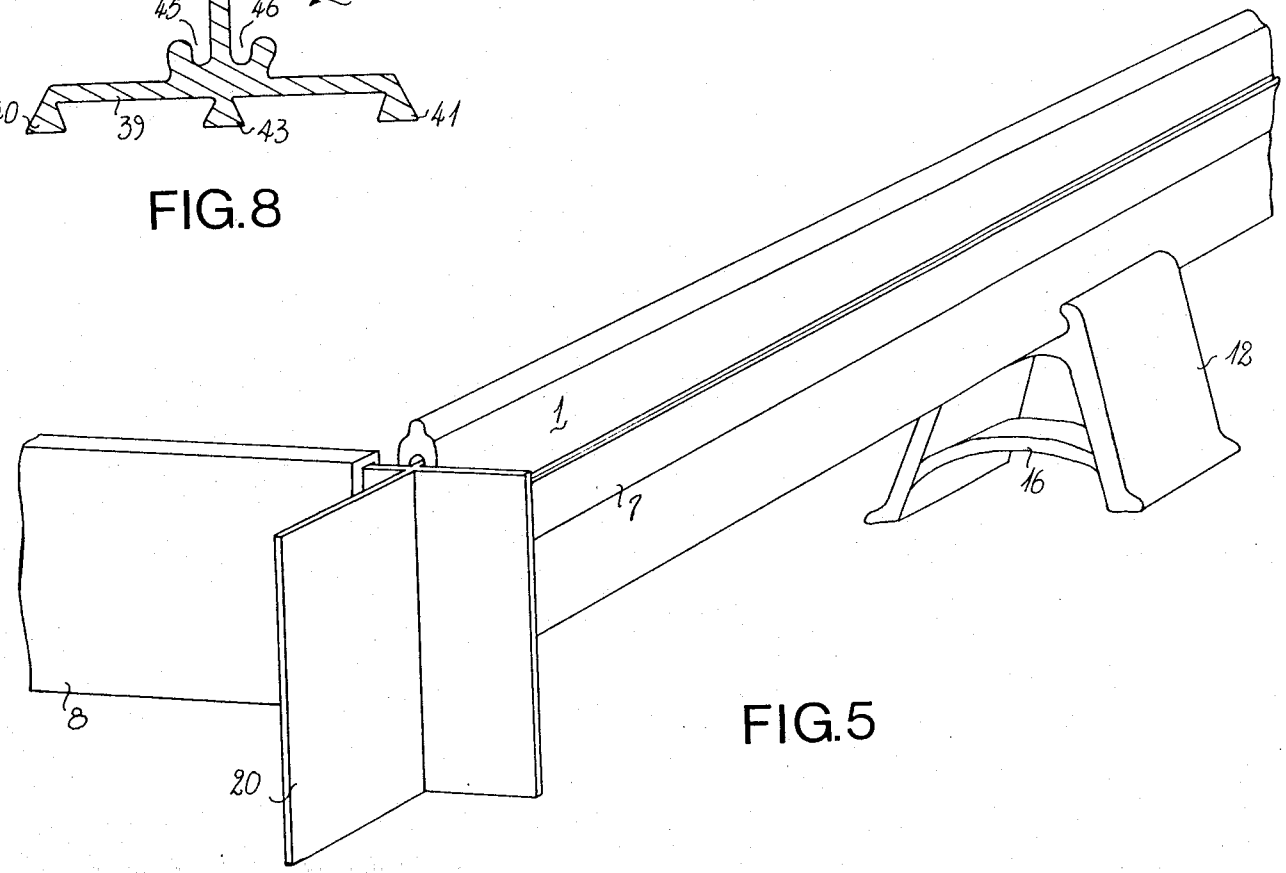
FIG. 5 is a persepective view illustrating how the parts of FIGS. 1 to 3 can be assembled.
Figure 10:
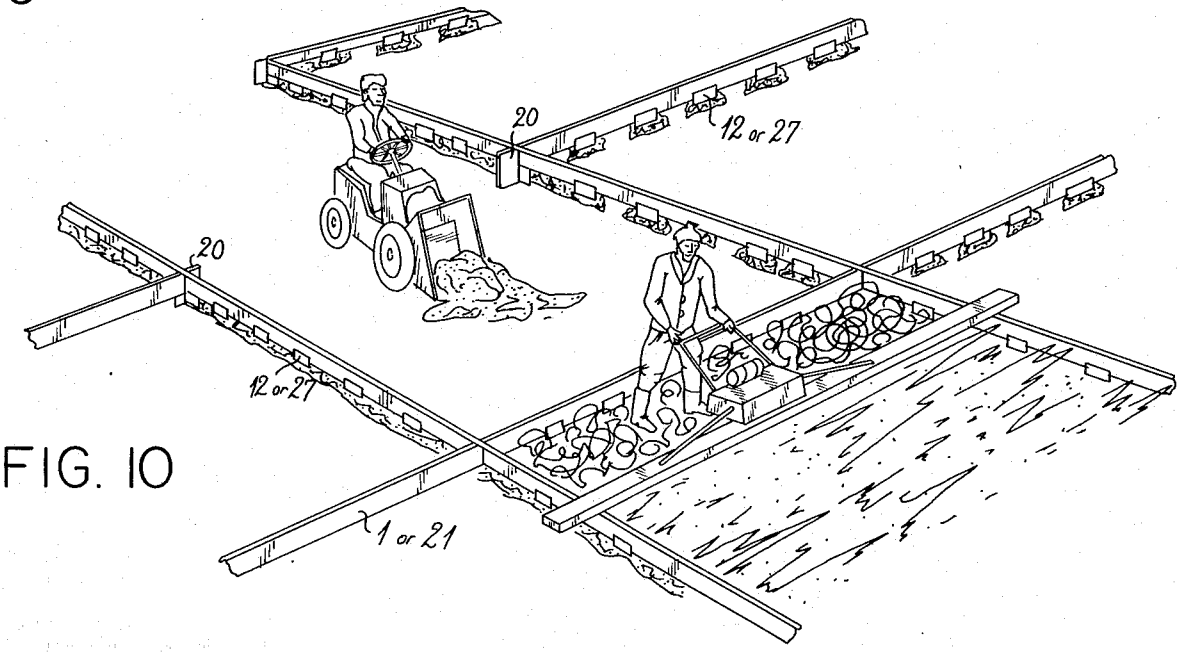
FIG. 10 is a perspective schematic view illustrating how the apparatus in accordance with the invention are used in a flooring construction work site.

As shown in FIGS. 5 and 10, this assembly of pieces can serve as shuttering and support to the vibrating rod to assure settling and levelling of fresh cement, and, on the other hand, to realize a joint. By using parts 1 and 12, we can produce a dry joint, part 1 remaining, by the two spurs 6 and 7, rigidly locked to the cement after removal of the latter. By using parts 8 and 12, we can obtain, after removal of part 8, once the cement has been poured, a joint to be blocked with putty.

As shown again in FIGS. 5 and 10, we realize with apparatus in accordance with the invention a lattice network, the crossing points of the network being formed by parts 20, whose heights correspond to those of parts 12. Parts 1 have their extremities threaded on the lugs of parts 20. Of course, bars 1 or 8 are a single piece between two crossover points, while parts 12 which support them are of shorter length and located here and there. Thus, we do not have imperviousness between adjacent squares of the network, but the cracks due to retraction are located along the bars of the network. Profile 1 is destined to remain submerged in the flooring concrete and to instigate the expansion joint. By its particular form, it fits perfectly on support 12 and thanks to the two spurs 6 and 7, it remains perfectly rigidly locked to the cement. The walls 2 and 3 are made of a material that is sufficiently flexible to follow the eventual motions of the cement. Profile 8 is destined to be recuperated. Its lower portion is thus narrower to allow an easy extraction from the cement once it has taken hold. It will thus leave a small linear crack in the cement. It will later be filled with putty.

The network of parts 1 and 12 and eventually 8 and 20 will be put in place the day before the flooring is poured, and supports 12 as well as the crossover points 20 will be partially submerged in a first cement pouring, in order to ascertain the levelness and rigidity of bars 1 and 8. This levelling cement will have the smallest possible volume. It will guarantee the perfect sealing of supports 12 and the crossover points 20 and should not forbid the eventual installation of a welded lattice. The next day, as illustrated in FIG. 10, the workers can pour the cement and insure its settling with a vibrating rod if so desired. If the 1 profiles have been chosen, they will remain in the cement and will serve as expansion joints. With the 8 profiles, they must be recuperated once the cement has taken and thus fill in the resulting cracks with an appropriate putty.

These apparatus, object of the invention, will fine an application in all floorings prone to contraction and where expansion joints are necessary.

Figure 6:
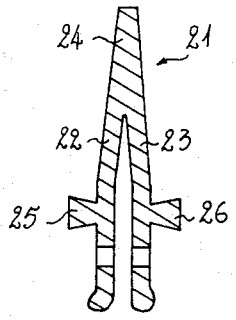
FIG. 6 is a sectional view of a variation of the part of FIG. 1.

Profile 21 of FIG. 6 represents a variation of that of FIG. 1. It also comprises two legs 22 and 23, forming with the summit 24, the shape of a clothes pin. The legs 22 and 23 have spurs 25 and 26, similar to the spurs 6 and 7. The summit 24 is clearly higher than summit 4. In practice, this profile is preferred because it is simpler and less expensive to fabricate than profile 1.

Figure 7:
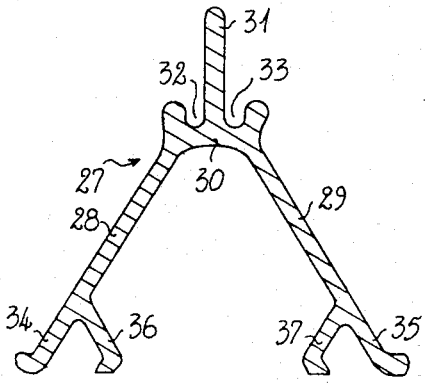
FIG. 7 is a sectional view of a variation of the part of FIG. 3.

Profile 27 of FIG. 7 represents a first variation of that in FIG. 3. It has, in a general way, the same A shape in which the horizontal bar 16 has been removed. More specifically, we can define this profile as an inverted V, with legs 28 and 29 reunited by a summit 30 having a vertical bar 31, analogous to 17, and having two hollows 32 and 33, analogous to 18 and 19. The feet of legs 28 and 29 respectively have points 34 and 35 practically aligned with the respective legs, and ankles 36 and 37 which buttress against the legs. This preferred profile where the ankles 36 and 37 prevent too much widening of the legs, as does 16 in 12, is less expensive to produce than profile 12.

Figure 8:
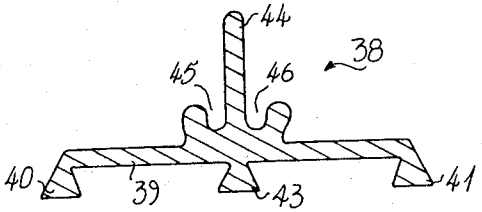
FIG. 8 is a sectional view of a variation of the part of FIG. 7.

Profile 38 of FIG. 8 represents a variation of that in FIG. 7. Instead of legs 28 and 29 in V shape, it has a horizontal plate 39, under which are foreseen extreme legs 40 and 41, and a central leg 43. The legs 40, 41 and 43 can have the shape of a dovetail for a better anchoring. Plate 39 is surmounted by a bar 44, analogous to 17, framed by two hollows 45 and 46, analogous to 18 and 19. Part 19 is visibly not as tall as part 27.

Figure 9:
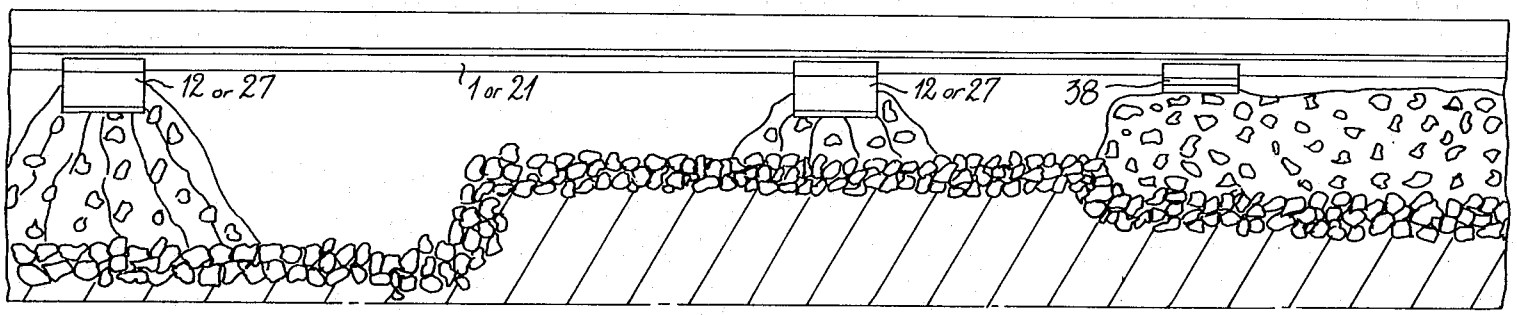
FIG. 9 is a sectional schematic view illustrating how the parts of FIGS. 6 to 8 can be used.

As shown in FIG. 9, part 38 is intended to be used when the surface has irregularities which make the use of parts 27 more awkward.

These apparatus resulting from the combination of parts in accordance with the invention are applicable for all flooring prone to have retraction or where expansion joints are necessary.

I claim:

1. A joint for use in a concrete deposit, said joint being made of a plurality of spaced vertical supports, each of said supports being an integral structure having two oblique anchoring legs and an upwardly extending lug portion with hollowed sections on opposite sides of the lugs, an elongated unitary joint body having a downwardly oriented U-shaped cross section forming two spaced vertical flange legs for straddling and completely covering said lug portions of said spaced vertical supports, the tips of the U-shaped cross sections fitting into the hollowed sections, each of the outside faces of said vertical flange having outwardly projecting spurs for hooking into the concrete.

2. The joint according to claim 1, wherein each of said integral vertical supports has an A-shape, the lug portion being extended upwardly from the apex of the A-shape.

3. The joint of claim 2 wherein the apex of said A-shape has recesses formed on opposite sides of the lug portion for receiving the bottom tips of the U-shaped cross section of said body.

4. The joint of claim 2 wherein the apex of said inverted V-shape has recesses formed on opposite sides of the lug portion for receiving the bottom tips of the U-shaped cross section of said body.

5. The joint of claim 2 in which there are a plurality of said elongated joint bodies arranged in a grid pattern whereby at least two of said joint bodies meet in at least one cross point, and cross point joining sections comprising supports having two vertically intersecting planes forming angles corresponding to the angles of said jointed bodies in said grid pattern, the vertical height of said planes corresponding to the vertical heights of said vertical supports whereby said bodies lie horizontally when they are supported by their U-shaped cross section straddling the legs and planes.

6. The joint according to claim 1, wherein each of said vertical supports has an inverted V-shape, the lug portion being extended upwardly from the apex of the inverted V-shape.

7. The joint according to claim 6 wherein each of the lower ends of the legs formed by the inverted V-shape are in the shape of a foot with a point and a buttressing ankle.

8. The joint of claim 6 in which there are a plurality of said elongated joint bodies arranged in a grid pattern whereby at least two of said joint bodies meet in at least one cross point, and cross point joining sections comprising supports having two vertically intersecting planes forming angles corresponding to the angles of said jointed bodies in said grid pattern, the vertical height of said planes corresponding to the vertical heights of said vertical supports whereby said bodies lie horizontally when they are supported by their U-shaped cross section straddling the legs and planes.

9. The joint of claim 1 wherein the top end of said downwardly oriented U-shaped body has a somewhat triangular cross section, thereby giving the elongated body a cross section with a somewhat clothes pin shape.

10. The joint of claim 1 in which there are a plurality of said elongated joint bodies arranged in a grid pattern whereby at least two of said joint bodies meet in at least one cross point, and cross point joining sections comprising supports having two vertically intersecting planes forming angles corresponding to the angles of said jointed bodies in said grid pattern, the vertical height of said planes corresponding to the vertical heights of said vertical supports whereby said bodies lie horizontally when they are supported by their U-shaped cross section straddling the legs and planes.

* * * * *